US005975727A

United States Patent [19]

Morstein et al.

[11] Patent Number: 5,975,727

[45] Date of Patent: Nov. 2, 1999

[54] EXTERIOR LIGHT POLE MOUNTING BRACKET

[75] Inventors: Jerome N. Morstein, Columbia, Md.; Douglas Jerry Daly; George Allen Scott, both of Baton Rouge, La.

[73] Assignee: Site Photometrics, Inc., Linthicum, Md.

[21] Appl. No.: 08/851,539

[22] Filed: May 5, 1997

[51] Int. Cl.[6] ..... F21S 5/00

[52] U.S. Cl. ..... 362/431; 362/249; 362/267; 362/414; 248/219.2

[58] Field of Search ..... 362/431, 414, 362/410, 267, 249, 405; 248/218.4, 219.2

[56] References Cited

U.S. PATENT DOCUMENTS

| | | | |
|---|---|---|---|
| 1,085,144 | 1/1914 | Massey | 362/431 |
| 1,834,535 | 12/1931 | Riemenschneider | 362/431 |
| 3,270,480 | 9/1966 | Beecker | 362/431 |
| 3,508,731 | 4/1970 | Jablonski | 248/221 |
| 3,721,463 | 3/1973 | Attwood et al. | 248/219.2 |
| 4,064,432 | 12/1977 | Compton et al. | 362/457 |
| 4,074,941 | 2/1978 | Jablonski | 403/260 |
| 4,167,352 | 9/1979 | Pletscher | 403/104 |
| 4,228,487 | 10/1980 | Hesse et al. | 362/240 |
| 4,797,798 | 1/1989 | Schumaker et al. | 362/413 |
| 5,197,349 | 3/1993 | Herman | 74/551.1 |
| 5,260,860 | 11/1993 | Jordan et al. | 362/431 |
| 5,419,650 | 5/1995 | Hoshino | 403/370 |
| 5,599,094 | 2/1997 | Fischer et al. | 362/414 |
| 5,632,553 | 5/1997 | Huang | 362/410 |

*Primary Examiner*—Alan Cariaso
*Attorney, Agent, or Firm*—Donald C. Casey, Esq

[57] ABSTRACT

A mounting bracket for mounting an exterior luminare on a support pole is described. The bracket is intended to be secured by compression fastening within the hollow upper end of the pole and to mount a support for individual luminares. The compression connection includes a lower compression plate, an intermediate cylindrical sleeve, and an upper compression plate which rests on the open top of the support pole. O-rings are disposed respectively between the lower plate and the sleeve and between the upper plate and the sleeve, and an axial rod is provided which extends through both plates and the sleeve so that the rod can be used to draw the plates together, and cause the O-rings to expand into a wedging relationship with the interior surface of the pole. The rod then in turn mounts an upper support for the luminare fixtures.

15 Claims, 4 Drawing Sheets

EXTERIOR LIGHT POLE MOUNTING BRACKET

FIELD OF THE INVENTION

This invention relates to mounting brackets for luminares utilized in all general area lighting applications. In particular, this invention relates to a mounting bracket for securing luminares to parking lot or freeway light poles so that the luminares can be precisely adjusted relative to the area to be lighted, and mounted on the pole, after the pole has been mounted vertically on its base.

DESCRIPTION OF THE PRIOR ART

In prior art structures, typically the luminare is attached to a support, electrical wiring coupled through the support to the luminare, and the structure bolted to the top of a light pole, all of this construction occurs, of necessity, while the pole is in a horizontal position on the ground. This is because the support will consist of a number of pieces which could not be assembled while working with a vertical pole without great difficulty. The assembled pole is then lifted into a vertical position and set on anchor bolts. Typically, the top pole section would be provided with pre-drilled bolt holes so that the luminare support would be bolted directly to the pole. An alternative would involve field drilling of the mounting holes. If the hole tolerances are incorrect then, or if the holes or anchor bolts were misaligned, substantial problems can result. A luminare in this situation would not be mounted to optimize its coverage on the desired portion of the ground below. In the case of bolted-on luminares, there also would no ability to adjust the luminare if the bolt holes were misaligned without re-drilling in the field. Furthermore, assembly of each luminare on its support and on the pole is labor intensive and time consuming.

This problem can be further compounded when the light pole is manufactured and shipped in multiple sections, as field assembly of the pole may create alignment problems between the predrilled luminare mounting holes and the baseplate.

In U.S. Pat. No. 4,064,432 there is described a mounting bracket wherein a compression type connector is used to connect a light fixture to a hollow pole. In this instance, as a bolt is tightened, wedge members are drawn together, which in turn drive metal spreader bars against the internal surface of the light pole. The dogging action by the spreader bars against the pole internal surface is relied upon to secure the luminare. It has been found, however, that use of spreader bars and a dogging action thereby does not provide sufficient support for large, outdoor street lights. The contact area between the bracket and the internal pole surface is not sufficient to stabilize an exterior light fixture against normal wind and weather conditions.

Compression joints of many different varieties are known in the prior art. In, for example, U.S. Pat. No. 4,228,487 a composite lamp assembly is provided wherein bolts with wedge members are expanded against the internal surface of the bracket and in U.S. Pat. No. 4,797,798, an interior light structure is provided wherein the bracket uses spring operated or biased spreader bars within the lamp pole structure for stabilization.

Other light support structures are described, for example, in U.S. Pat. No. 4,167,352 wherein a bolt is used which when tightened draws wedge members upwardly into a dogging action and a similar relationship is shown in U.S. Pat. No. 5,197,349. As pointed out above, however, it has been found that the dogging action from spreader bars, is insufficient support for an exterior light structure such a freeway type light.

Other mounting joints are shown, for example, in U.S. Pat. Nos. 5,419,650, 4,074,941, and 3,508,731.

SUMMARY OF THE INVENTION

It has been discovered that a unitary mounting bracket for exterior luminares can be provided which can be easily affixed to the top of a light pole and is adjustable so that the luminares can be oriented as desired. The bracket of this invention is intended to be mounted on the top of a hollow light pole of any conventional design. In a preferred embodiment, factory or field-drilled mounting holes, are not required, and no exposed or visible fasteners are provided on the pole itself. The bracket in this embodiment includes a sleeve which surrounds a central shaft. The shaft has a compression plate affixed to the bottom thereof and a bottom O-ring is disposed between the bottom compression plate and the bottom edge of the sleeve. An upper compression plate is also provided which surrounds the upper portion of the shaft and which has an external flange so that the upper compression plate can be seated in the opening of the light pole. An upper O-ring is provided between the upper surface of the sleeve and the upper top compression plate. The upper compression plate then supports a cylindrical mount for the luminare arms and extends above the pole and to be held in place by an extension of the central shaft to a threaded coupling.

During assembly, unitary fitter or bracket with assembled luminares is mounted on the hollow, vertically assembled pole with the sleeve and the upper and lower O-rings received within the hollow light pole so that when the threaded coupling is tightened, the compression plates will draw together, causing the O-rings to expand against the internal sleeve and thereby grip the inner surface of the pole. One, two, three, four or more arms can be mounted on the upper extension in a conventional fashion to support the luminares, and the entire structure can be quickly fitted in place and adjusted as desired in the field.

Accordingly it is an object of this invention to provide a unitary mounting bracket for exterior luminares which is quickly and easily assembled in the field and which will securely attached the luminares to a hollow light pole.

It is another object of this invention to provide an assembly that will allow the joining of the assembly, and the luminares, to the light pole while the pole is in the vertical, not horizontal, position.

It is another object of this invention to provide an adjustable bracket for mounting luminares on a hollow light pole so that the luminares can be adjusted and aligned as desired in the field quickly and easily and then affixed to the pole with a sufficiently strong support that will withstand wind and weather.

It is another object of this invention to provide a compression mounting for a light support bracket for exterior street type lights wherein a pair of O-rings are disposed above and below a compression sleeve, and compression plates are further provided above and below the O-rings so that when the plates are drawn together the O-rings will expand against the inner surface of a hollow street light and thereby secure the bracket to the light pole.

These and other object will become readily apparent with reference to the drawings and following description wherein:

DETAILED DESCRIPTION OF THE INVENTION

Figure 1:
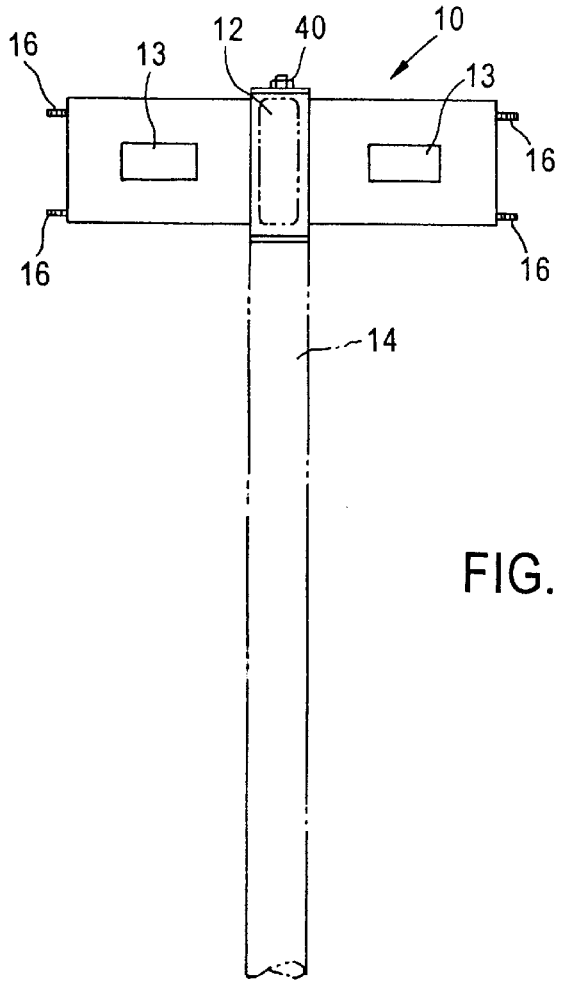
FIG. 1 is a side view of a preferred embodiment of the mounting bracket of this invention assembled on a light pole.
Figure 2:
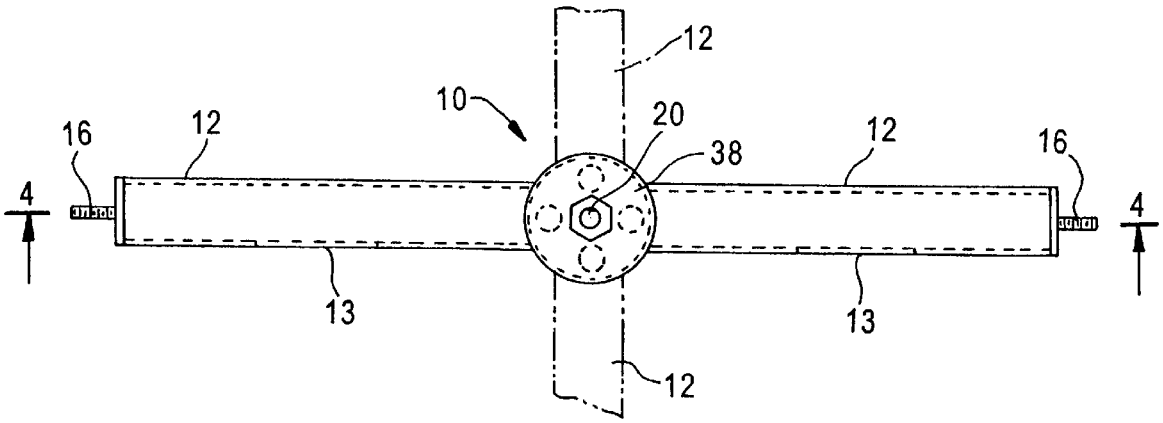
FIG. 2 is an assembled plan view of the mounting bracket of this invention.

The device of this invention is a unitary mounting bracket 10 which is intended to support one or more arms 12 which in turn support any style of commercially available or custom luminares (not shown) at the upper end of a hollow light pole 14. The light pole 14 is preferably of the exterior type used, for example, with freeway, street or parking lot lighting. The bracket of this invention 10 as shown in FIGS. 1 and 2 is supporting four arms 12, but as will be obvious to those skilled in the art, one, two or more of such arms can be utilized. It is not intended that the invention be limited to the number of arms supported by the bracket of this invention. Access doors 13 are provided in each arm 12 to permit an electrical connection to be made between a luminare and wiring within pole 14.

In addition, in FIGS. 1 and 2, for example, bolts 16 are shown at the ends of the arms 12 as representative of a conventional mounting means to mount conventional light fixtures or luminares. The light fixtures or luminares arc not shown. Furthermore, as will be obvious to those skilled in the art, any conventional mounting means can be used on the end of arms 12, and this invention is not intended to be limited to the bolts shown.

Figure 3:
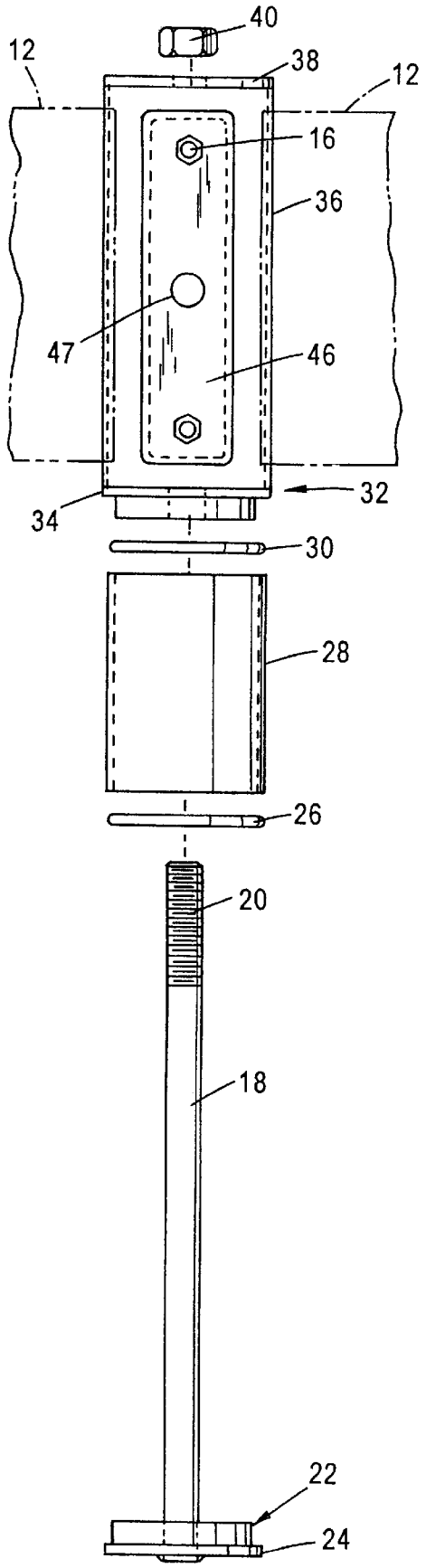
FIG. 3 is a an exploded view of the mounting bracket of this invention with luminare support arms removed.
Figure 4:
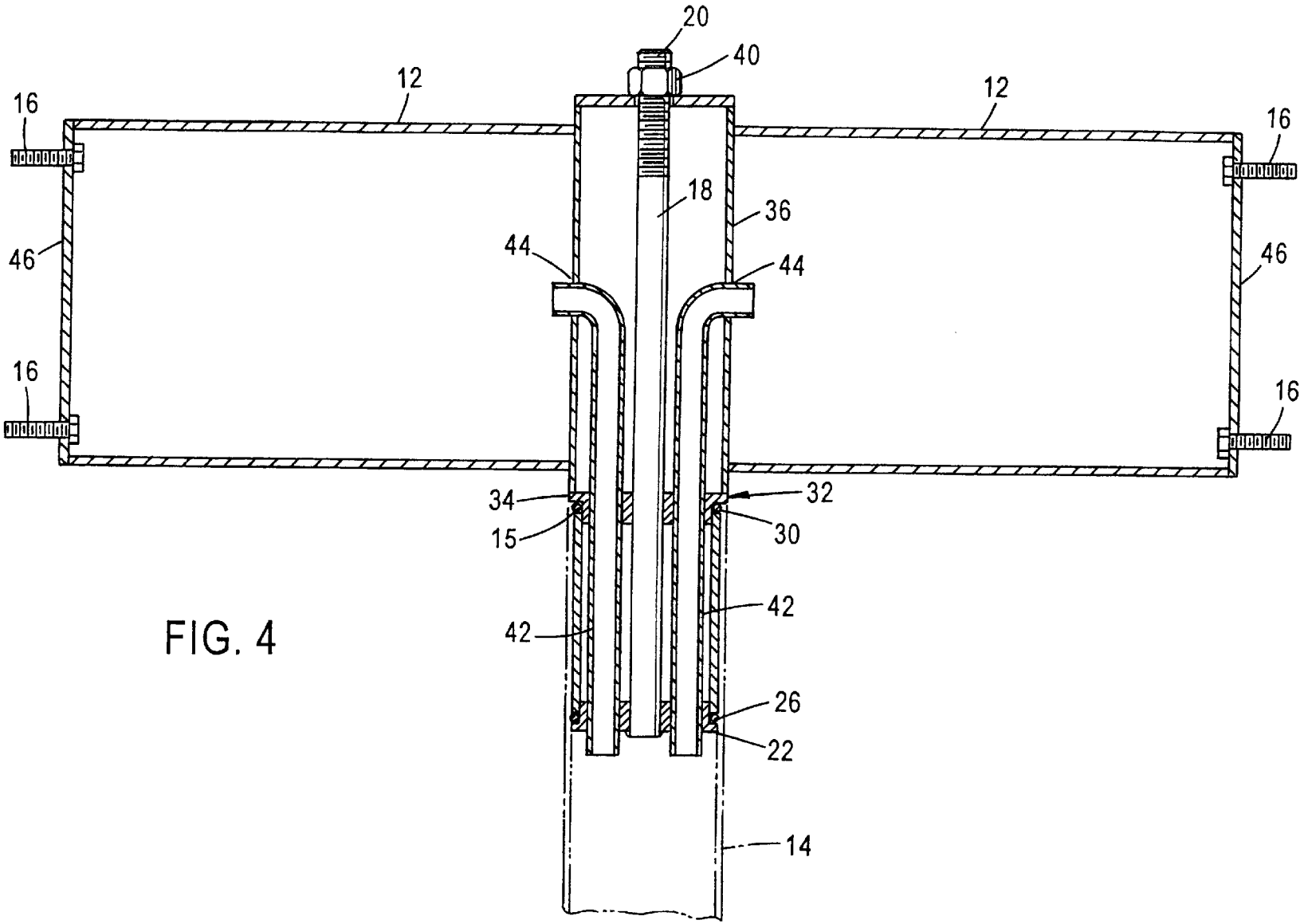
FIG. 4 is an assembled cross-sectional view taken along lines 4 4 of FIG. 2.
Figure 5:
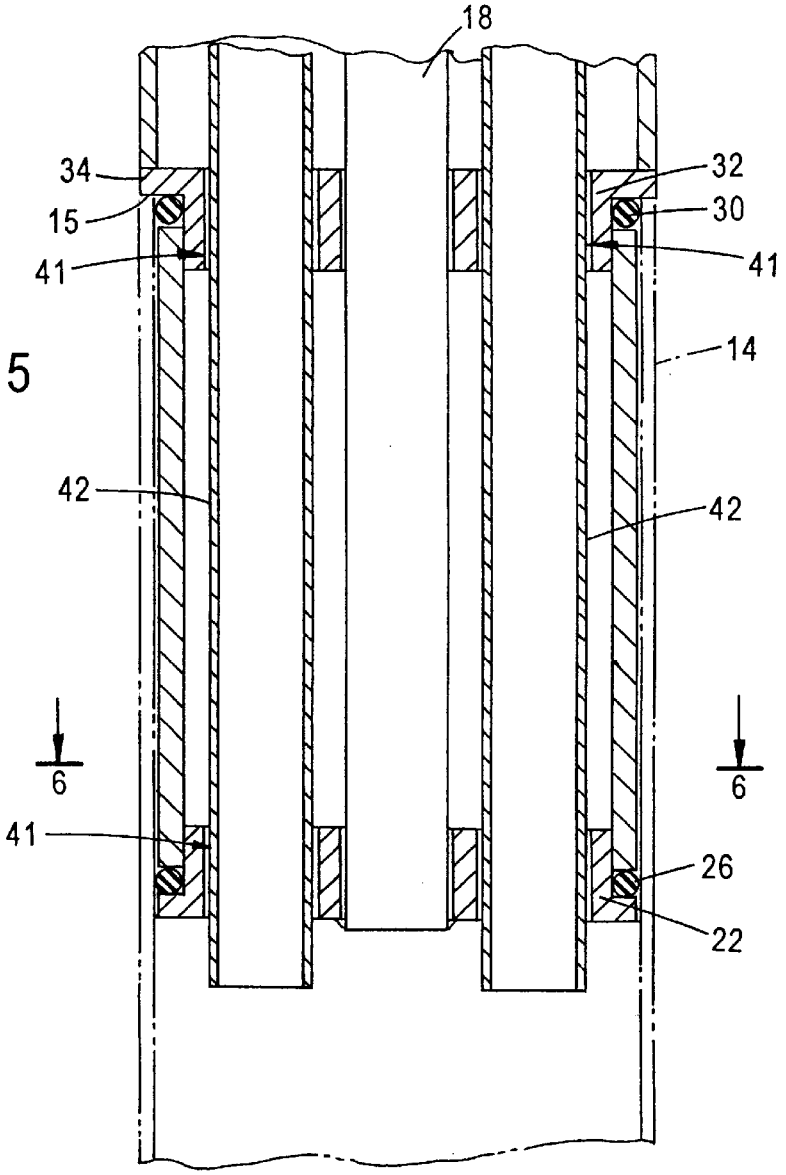
FIG. 5 is a fragmentary view in section of the compression mounting for the device of this invention.

With attention to FIG. 3 there is shown therein an exploded view of the preferred mounting bracket of this invention without the pole 14. FIG. 4 is an assembled view similar to FIG. 3, but showing the pole 14. With attention to FIGS. 3 and 4 then, the device of this invention utilizes a central shaft 18 having an upper threaded end portion 20 and a lower compression plate 22 mounted at the opposite end thereof. Compression plate 22 is intended to have an external flange 24 which will be dimensioned to correspond to the inner diameter of the hollow pole 14 as shown in FIG. 4.

The plate 22 then should be slideable within the pole 14, and the flange 24 should extend outwardly but clear the inner surface of pole 14. A lower flexible O-ring or compression ring assembly 26 is intended to be received on flange 24. A compression sleeve 28 is then slideably received within the hollow pole 14 and an upper O-ring or compression ring assembly 30 is disposed thereover. An upper compression plate 32 is provided which has an exterior flange 34. O-ring 30 is intended to be received on compression plate 32 and to be disposed between the upper surface of sleeve 28 and the flange 34 of plate 32.

Plate 32 mounts the upwardly extending mounting bracket 36 which in turn mounts the arms 12. An upper cover plate 38 is provided so that the threaded end 20 of shaft 18 will extend upwardly to a threaded coupling 40. When threaded coupling 40 is tightened onto end 20, the lower compression plate 22 will be drawn upwardly against upper compression plate 32 causing O-rings 26 and 30 to expand between the respective plates 22 and 32 against the inner surface of the pole 14 to thereby secure the upwardly extending mounting bracket 36. This tightening may be done with hand tools in the field as will be obvious to those skilled in the art. The central shaft 18 then achieves assembly after the compression sleeve and O-rings are inserted into the hollow end of the pole with the flange 34 on upper compression plate 32 seated against the top of the pole 15. Coupling 40 is then tightened down on threaded end 20 to secure the bracket on the light pole 14.

Figure 6:
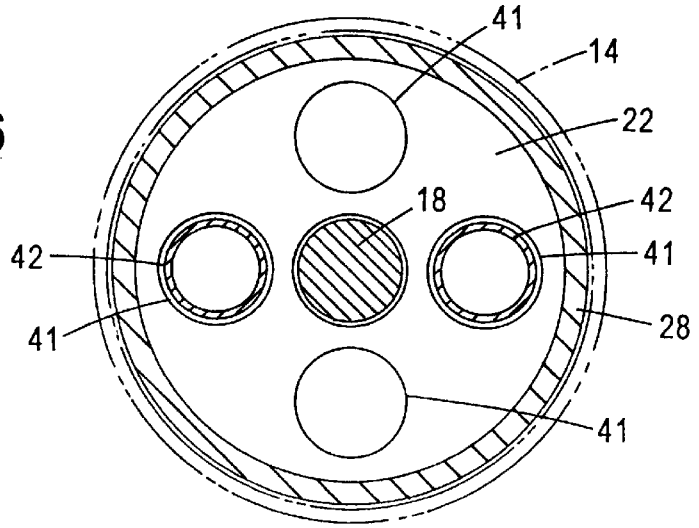
FIG. 6 is a cross-sectional view taken along lines 6 6 of FIG. 5.

As shown, for example, in FIG. 6, the shaft 18 is intended to extend axially upwardly through the light pole 14 and through plates 22 and 32. As shown therein holes 41 are also provided for conventional conduits 42 which extend upwardly and through hole 44 in exterior bracket 36. (See FIG. 4). The necessary electrical wiring is then fed through these conduits in the conventional fashion.

O-ring assemblies 26 and 30 are preferably single O-rings at least ¼ inch in diameter and of silicon or similar material. As will be obvious to those skilled in the art each assembly 26 or 30 could comprise a plurality of O-rings. The respectively upper and lower mating faces of sleeve 28 may have a 5 degree bevel.

As shown, for example, in FIGS. 3 and 4, each arm 12 terminates in a face plate 46 which mounts bolts 16 for mounting a luminare (not shown). A hole 47 therein can be provided for a conventional electrical connection. This invention is not intended to be limited to this type of a fixture mount for the luminare, and any conventional type of mounting means is intended to be used at the ends of arms 12 to mount the light fixtures which are not shown herein.

Typically, then the unitary bracket of this invention includes the component parts shown in FIG. 3. The luminares (not shown) are assembled on the arms 12 while on the ground. The pole 14 would be mounted vertically on a conventional base (not shown). The luminare and bracket structure is then raised and seated in the upper open end of the pole as shown in FIG. 4. The associated wiring is then dropped down the inside of the hollow pole from the bracket to the conventional base for attachment. In this way the structure can be assembled and mounted quickly with a minimum of labor.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

We claim:

1. A unitary mounting bracket for mounting one or more luminares on a support pole having a hollow upper end comprising:

a lower compression plate dimensioned to be slidably received in the hollow upper end of said pole and a rod having an upper and a lower end mounted on said plate at the lower end and extending axially upwardly from said lower plate; a compression sleeve slidably received on said rod and adapted to be received within the hollow end of said pole; an upper compression plate having an axial opening there through slidably received on said rod and dimensioned to rest on and cover the open end of said pole so that the upper end of said rod distal to said lower plate extends upwardly through said upper plate;

first and second O-ring assemblies disposed respectively between said lower compression plate and the lower edge of said compression sleeve and between the upper edge of said compression sleeve and said upper compression plate;

means for securing said bracket to a pole by drawing said upper and lower plates together against said O-rings and sleeve whereby said O-rings deform against the inner surface of the pole; and luminare mounting means abutting said upper plate and coupled to said rod for mounting at least one luminare structure on the support pole.

2. The bracket of claim 1 wherein said mounting means includes an elongated hollow housing coaxially surrounding an upper portion of said rod and having a lower edge abutting said upper compression plate; at least one support arm mounted at a first end on said housing and extending therefrom perpendicular to the longitudinal axis of said housing, said arm adapted to mount a luminare on the end opposite said housing.

3. The bracket of claim 2 wherein said securing means further comprises a cover plate having an axial opening therethrough said plate slidably receive on the upper end of said rod and covering the upper end of said cylinder and securing means carried by said rod for drawing said cover plate downwardly toward said lower compression plate.

4. The bracket of claim 3 wherein said upper end of said rod is threaded and said securing means includes a coupling threadedly received thereon.

5. The bracket of claim 2 wherein said compression plates define apertures therethrough adapted to receive electrical conduits therethrough for said luminare.

6. The bracket of claim 5 wherein said housing defines at least one aperture in a side thereof and said arm is hollow, the housing aperture being in registration with the arm so that an electric conduit from within said cylinder can extend into said arm.

7. The bracket of claim 1 wherein the upper and lower surfaces of said compression sleeve abutting said O-ring assemblies are beveled.

8. The bracket of claim 2 where a pair of said arms are provided mounted mutually spaced intervals around said housing.

9. The bracket of claim 2 wherein two pairs of said arms are provided mounted at mutually spaced intervals around said housing.

10. The bracket of claim 2 wherein at least three of said arms are provided at mutually spaced intervals around said housing.

11. The bracket of claim 1 wherein the circumferential edge of said lower compression plate defines an L shaped groove therearound receiving said lower O-ring assembly.

12. The bracket of claim 1 wherein the circumferential edge of said upper compression plate defines an L shape groove therearound receiving said upper O-ring assembly.

13. The bracket of claim 2 wherein said at least one arm has an access door therein for accessing the hollow interior of said arm whereby an electrical connection to the luminare mounted thereon can be made.

14. The bracket of claim 2 wherein said hollow housing is cylindrical.

15. A method for mounting at least one luminare support bracket on a hollow support pole with an open end comprising the steps of:

providing a mounting bracket having an arm adapted to mount each luminare and a central supporting hub, each arm extending radially from said hub and having a luminare mount at the distal end thereof, and compression mounting means carried by said hub for attachment to a pole; comprising upper and lower compression plates, a central sleeve disposed therebetween and upper and lower O-ring seals;

assembling said pole in a vertical position with the open end opening upwardly; and mounting said bracket on the open upper end of said pole by raising said bracket to the upper open end of said pole and inserting said mounting means into the open end, and subsequently drawing said plates together expanding said seals against the interior of said pole.

* * * * *